US007042694B2

(12) United States Patent
Vernitsky et al.

(10) Patent No.: US 7,042,694 B2
(45) Date of Patent: May 9, 2006

(54) SELF-BALANCING SHIELDED BIPOLAR IONIZER WITH AIR ASSIST

(75) Inventors: Gregory Vernitsky, San Francisco, CA (US); Aleksey Klochkov, San Francisco, CA (US)

(73) Assignee: Ion Systems, Alameda, CA (US)

( * ) Notice: Subject to any disclaimer, the term of this patent is extended or adjusted under 35 U.S.C. 154(b) by 265 days.

(21) Appl. No.: 10/713,330

(22) Filed: Nov. 17, 2003

(65) Prior Publication Data

US 2005/0105242 A1 May 19, 2005

(51) Int. Cl.
*H05F 3/06* (2006.01)

(52) U.S. Cl. ..... 361/213

(58) Field of Classification Search ..... 361/212, 361/213, 229

See application file for complete search history.

(56) References Cited

U.S. PATENT DOCUMENTS 4,635,161 A * 1/1987 Le Vantine ..... 361/213
5,065,272 A * 11/1991 Owen et al. ..... 361/231
6,069,314 A * 5/2000 Varela ..... 174/3
2004/0114299 A1* 6/2004 Lu et al. ..... 361/212

* cited by examiner

*Primary Examiner*—Phuong T. Vu
*Assistant Examiner*—Scott Bauer

(57) ABSTRACT

An improvement for a self-balancing shielded bipolar ionizer (U.S. Pat. No. 6,002,573), which uses pressurized air or nitrogen to increase performance, extend the operating distance range, and reduce cleaning frequency. An air assist assembly is inserted into the ion generation cavity, which directs pressurized air or nitrogen past the electrodes. In applications where little natural airflow exists, air assist technology is particularly useful. Ions are blown toward the target. This directs the ions to where they are needed, and delivers ions faster. Useful operating distances are increased. Faster delivery minimizes ion losses due to recombination. Furthermore, pure pressurized air protects the electrodes from impurities in the environmental air. Less chemical growth affects electrode performance. Hence, the ionizer exhibits more stable performance, plus the need for electrode cleaning is minimized.

30 Claims, 10 Drawing Sheets

SELF-BALANCING SHIELDED BIPOLAR IONIZER WITH AIR ASSIST

CROSS-REFERENCE TO RELATED APPLICATIONS

Not Applicable

STATEMENT REGARDING FEDERALLY SPONSORED RESEARCH

Not Applicable

REFERENCE TO A MICROFICHE APPENDIX

Not Applicable

BACKGROUND OF THE INVENTION

1. Field of the Invention

This invention relates to the field of air ionization, which is used to remove static charge from objects in critical process environments. Critical process environments include manufacturing or research facilities for semiconductors, disk drives, flat panel displays, optoelectronic devices, and nanotechnology processes. Positive and negative ions created by the air ionization are attracted to statically charged surfaces with opposite charge. Hence, surface charge is neutralized.

Gas (or air) molecules are ionized with sharp electrodes to which high voltage is applied. Ions are carried away from the sharp electrodes and toward the target (the object to be discharged) by electrostatic forces.

Properly designed addition of pressurized gas (or air) results in a performance improvement, relative to a same self-balancing shielded bipolar ionizer without pressurized gas. Performance parameters include discharge time, effective functioning distance, and balance.

2. Description of Related Art

The subject matter of this disclosure is an improvement to U.S. Pat. No. 6,002,573, issued Dec. 14, 1999 to inventor Leslie W. Partridge, entitled "Self-balancing Shielded Bipolar Ionizer". Both this current invention and U.S. Pat. No. 6,000,573 are assigned to Ion Systems, Inc. and commonly owned by Ion Systems, Inc. in Berkeley, Calif.

U.S. Pat. No. 6,000,573 describes a self-balancing air ionization system based on at least two electrodes (and normally four electrodes) positioned within a recessed cavity. The recessed cavity is open only in the direction of ion production, which corresponds to the direction that the electrode tips are pointed. The electrodes are placed close together to achieve self-balancing. These self-balancing air ionizers are relatively small in size. Dimensions are 3.6"×1.4"×1.4" in the most common embodiment. However, these dimensions are not presented as a size limitation. Balance is achieved by generation of equal numbers of positive ions and negative ions. Insulative surfaces of the recessed cavity repel ions to be carried to target area by the ion current.

This prior art works well to remove static charge. But the useful operating distance between the ionizer and the object to be discharged depends upon airflow within the working environment. When environmental airflow is slow or stagnant, ionizer operation more than 6 inches from the target is marginally effective. Ions of opposite polarity recombine before reaching the target. Static charge neutralization requires long exposure times.

Dependence on environmental airflow makes it difficult to predict performance. Airflow patterns inside process equipment are not always known. Turbulence and reverse flows may carry the ions away from the target, rather than to the target. Positioning the ionizer in the best location involves guesswork or experimentation. Hence, the performance of the prior art self-balancing shielded bipolar ionizer depends on factors beyond the manufacturer's control.

One way to maximize performance of the prior art is to position the ionizer close to the target. But this involves risk. If an electrode gets too close to the target, localized charges ("hot spots") can be created on the target. This is counterproductive.

Prior art performance improvement can also be addressed at the design stage. For example, placing a higher voltage (or current) on the electrodes is possible. But higher voltage (other factors constant) results in higher particle generation, which is undesirable in clean processes.

Purity of environmental air is also a performance factor. If the environmental air contains impurities, these impurities can react with the electrode tips to form undesirable buildup. When this happens, cleaning is needed to restore the original discharge time, balance, and cleanliness. Depending on clean environmental air introduces another uncontrolled variable. The goal of this invention is to increase effectiveness (shorter discharge time, balance uniformity, longer time between maintenance) on this ionizer by providing purging air while preserving size, self-balancing and serviceability of a present design.

BRIEF SUMMARY OF THE INVENTION

This invention is an improvement based on a currently owned patent. It utilizes the "Self-balancing Shielded Bipolar Ionizer" described in U.S. Pat. No. 6,002,573, and adds the air assist technology. The air assist technology is the essential new addition. For clarity, the following definitions are used throughout:

(a) "Self-balancing shielded bipolar ionizer" means the ionizer described in U.S. Pat. No. 6,002,573 without modification.

(b) "Air assist self-balancing shielded bipolar ionizer" means the invention of this application.

U.S. Pat. No. 6,002,573, entitled "Self-balancing Shielded Bipolar Ionizer", is incorporated by reference in its entirety. Details contained within the patent are not repeated in this application. U.S. Pat. No. 6,002,573 was issued Dec. 14, 1999 to inventor Leslie Partridge and assigned to Ion Systems, Inc. in Berkeley, Calif. Current U.S. Class is 361/231. Attention is drawn to the "Detailed Description" on pages 6–9 plus FIGS. 1*a*, 1*b* 1*c*, 2, and 3.

The air assist technology comprises an air fitting and an air insert component. The air insert is made of electrically insulating material, and fully fits into the recessed cavity that contains the electrodes. A hermetic seal is created between the recessed cavity and the air insert to prevent air leakage.

Air delivery grooves distribute the pressurized air evenly to all the electrodes. This uniform air distribution is accomplished with a central plenum (a vertical bore) and air delivery grooves of equal length.

By design, the pressurized air blows past the electrodes and helps move the ions away from the electrodes and toward the target. The exterior surface of air insert assembly has a shape which helps to expel ions, and make it harder to develop a shorting path between electrodes of opposite polarity. Also, the air insert assembly may consist of a two-part housing and of emitters, hermetically sealed as removable unit.

The air assist self-balancing shielded bipolar ionizer is effective at greater distances than possible without the air assist. This is shown in the table below.

Average Discharge Time vs. Air Volume Past The Electrodes (Seconds, 1000 to 100 Volts)

| Air Volume | Discharge Time At Distance Indicated (inches) | | | |
|---|---|---|---|---|
| (lpm) | 3" | 9" | 18" | 29" |
| 0 | 6 | 43 | >60 | >60 |
| 6 | 5 | 19 | >60 | >60 |
| 10 | 4 | 9 | 25 | >60 |
| 15 | 3.5 | 5 | 12 | 39 |
| 20 | 3 | 4 | 8 | 18 |
| 25 | 2.5 | 3 | 5 | 10 |

The assisted self balancing shielded bipolar ionizer can operate with air volumes higher than 25 lpm and at distances greater than 29".

The air assist self-balancing shielded bipolar ionizer is less dependent on environmental sir flow. Ions are produced with an initial velocity, and that velocity is directed toward the target. Application engineers have greater latitude when selecting ionizer placement sites within equipment. Overall performance is less dependent on uncontrollable variables. Guesswork and experimentation are reduced.

With the air assist, application engineers are less likely to place ionizers too close to target surfaces. Performance goals can be met in other ways. Hot spots cease to be a concern.

The air assist creates new design possibilities. For example, lower voltages and currents on the electrodes may suffice to meet discharge times. Hence, lower particle shedding would result.

The air assist technology permits protection against buildup on the electrodes. Airflow around the electrodes provides a barrier to the environmental air. Even if the environmental air contains impurities, the impurities do not contact the electrodes. Employing high purity pressured air (or nitrogen) minimizes performance drift and minimizes cleaning frequency.

DETAILED DESCRIPTION OF THE INVENTION

Figure 1:
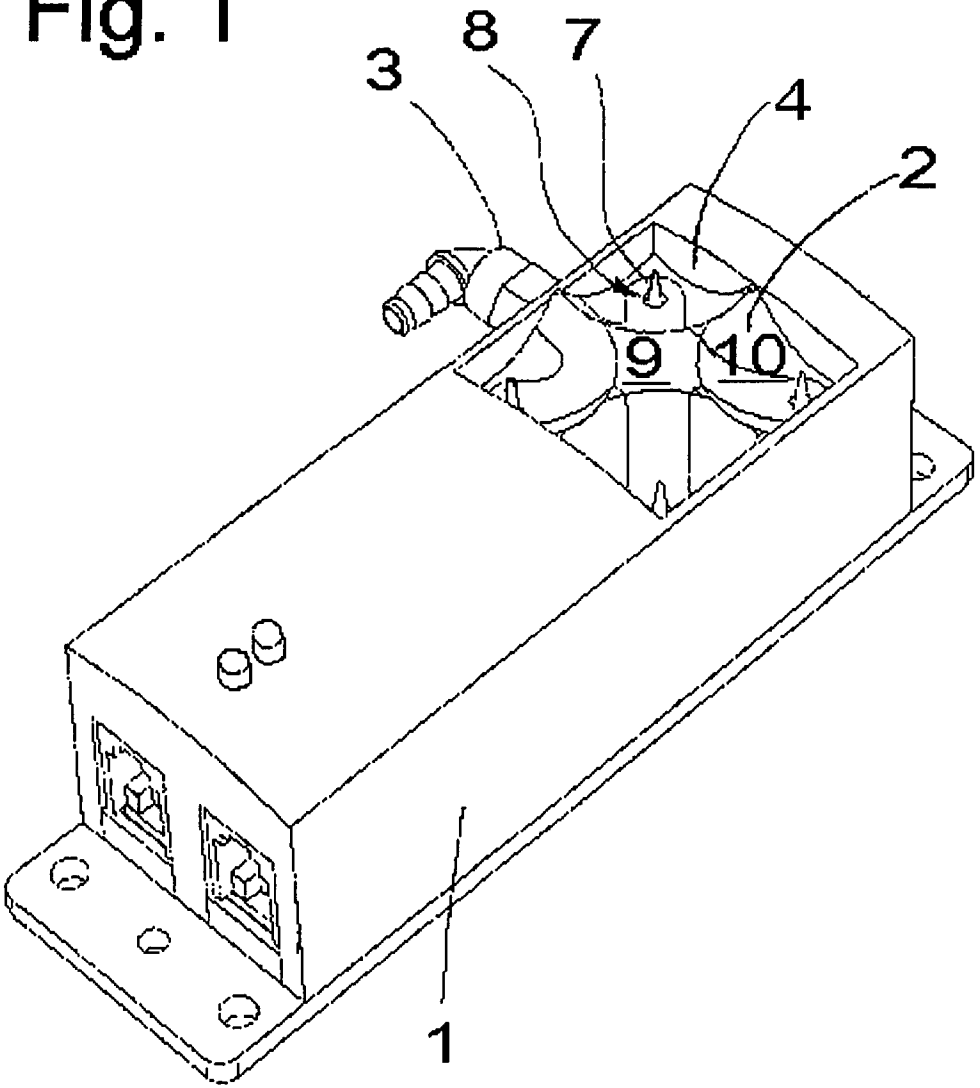
FIG. 1 is a top/left view of an air assist self-balancing shielded bipolar ionizer showing an air insert assembly in the recessed cavity plus an air fitting.

FIG. 1 shows an air assist self-balancing shielded bipolar ionizer 1. The air insert assembly 2 has been installed into the recessed cavity 4 of the self-balancing shielded bipolar ionizer described in commonly-owned U.S. Pat. No. 6,002,573. Pressurized air (or nitrogen) enters through the input air fitting 3, and exits through the holes 8 through which the electrodes 7 protrude. The holes 8 penetrate the air assist assembly 2, and the electrodes 7 extend above the external surface 9 of the air assist assembly 2. The air insert assembly 2 and electrodes 7 are situated fully within the relatively small recessed cavity. The maximum depth in the preferred embodiment is 0.41" (10.5 mm). However, 0.41 inches is not the appropriate depth in all embodiments.

Figure 2:
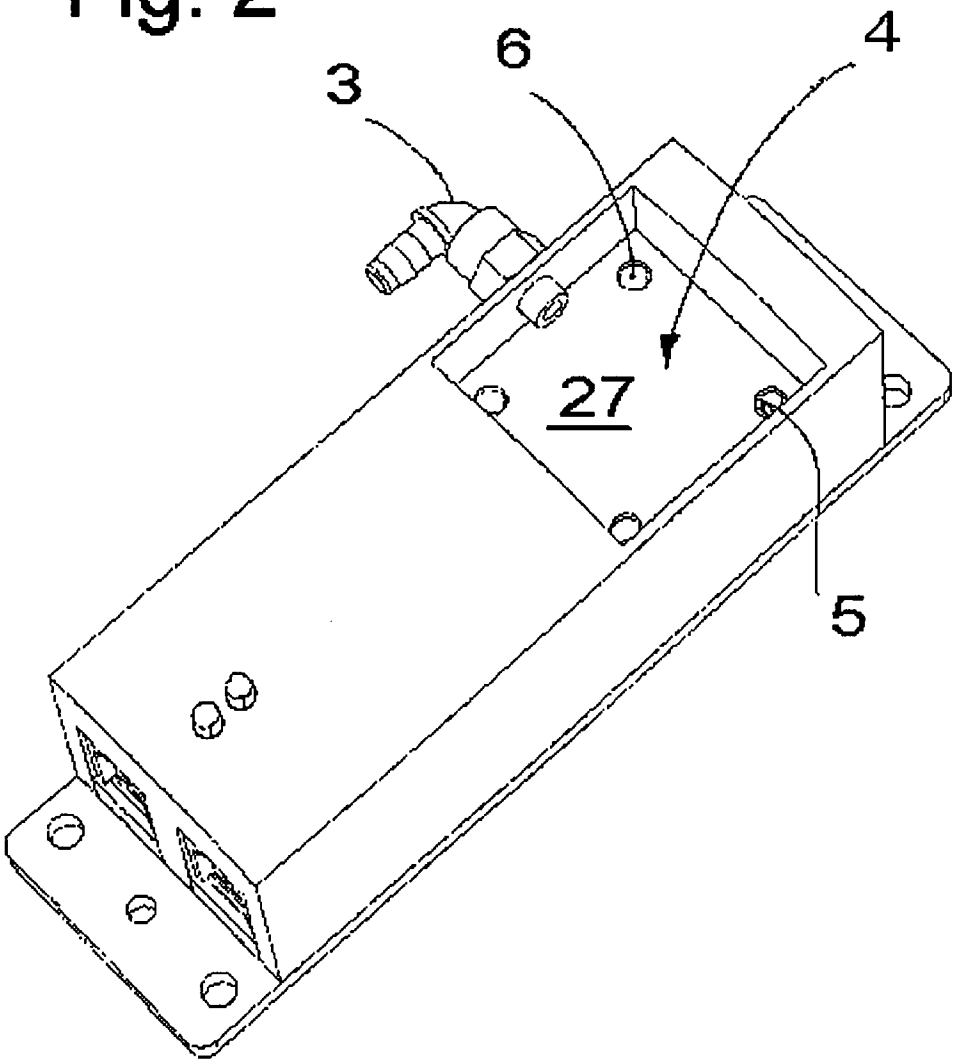
FIG. 2 is a top/left view of an air assist self-balancing shielded bipolar ionizer with an air fitting, but without an air insert assembly in the recessed cavity.

FIG. 2 shows the pressurized air inlet fitting 3 penetrating the recessed cavity 4 wall. Note that the air insert assembly 2 has been removed from this view. FIG. 2 also shows some elements of an unmodified self-balancing shielded bipolar ionizer (U.S. Pat. No. 6,002,573). For example, the voltage connectors 5 remain situated in the openings 6 at the base of the recessed cavity 4.

Figure 3:
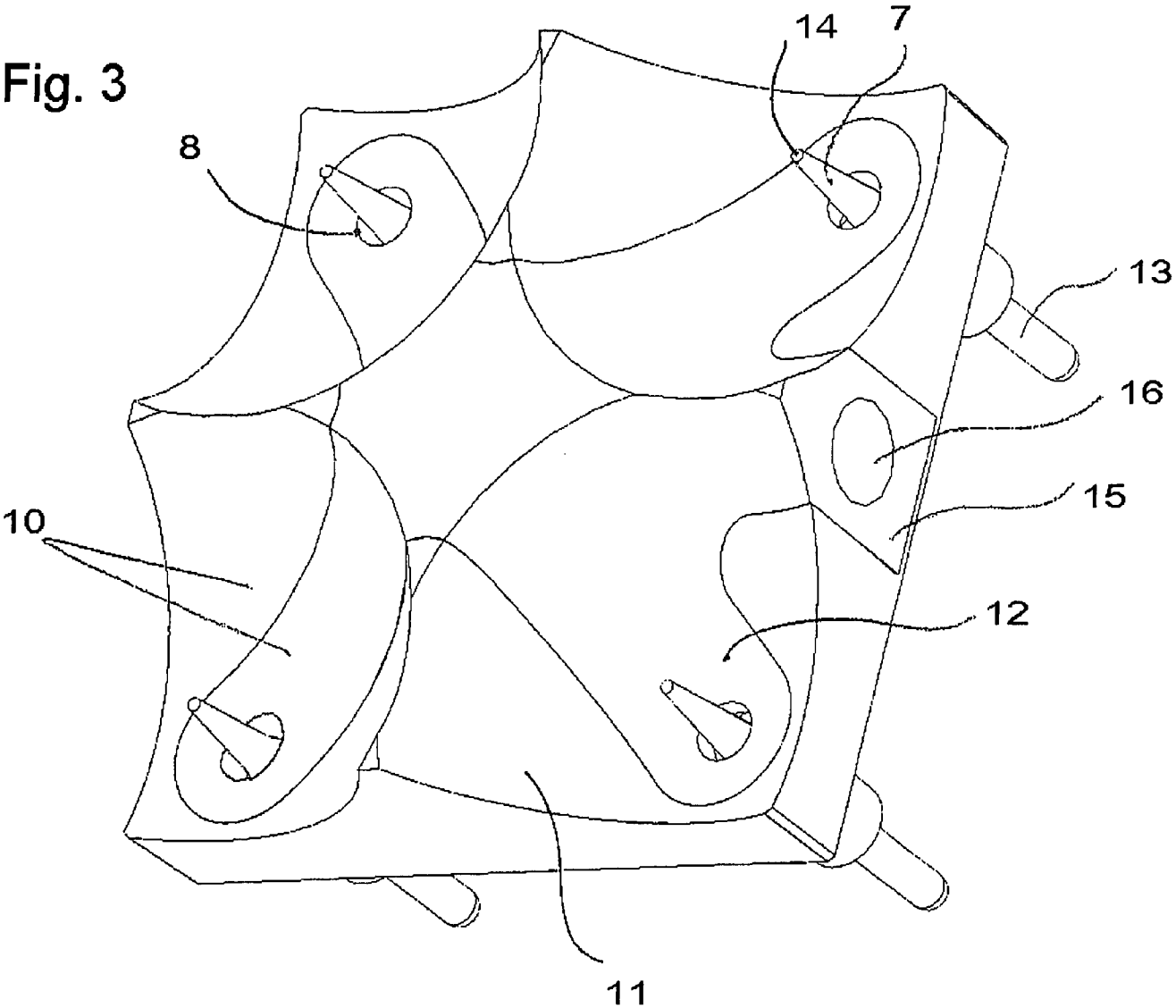
FIG. 3 is a top/right view of the external (visible) side of an air insert assembly (base and cross).

Refer to FIG. 3. The shape of the air assist assembly 2 embodies a concave surface 10 around each electrode 7. This concave surface 10 assists in directing ions toward the target. The pointed tips 14 of the electrodes 7 protrude through the holes 8. Protrusion distance varies with the shape of the specific air assist assembly employed, and is normally between 0.1–2.0 inches above the external surface of the air assist assembly. With some air assist assemblies, the pointed tips are placed at the focal point of the concave surface 10.

FIG. 3 shows that the air assist assembly 2 comprises two separate pieces in the preferred embodiment. These two pieces are the air insert base 11 and the air insert cross 12. It also shows that the concave surface 10 is formed from the combination of the air insert base 11 and the air insert cross 12. The curved shape of the air assist assembly 2 maximizes the effective distance between electrodes 7 of opposite polarity taken along surface 10, relative to the air distance between same electrodes. This geometry minimizes unproductive current flow between electrodes 7 of opposite polarity.

The air insert cross 12 shown in FIG. 3 shows an integral port 16 to mate with the input air fitting 3. This is the preferred embodiment, but other routes can deliver the air. When an integral port 16 is employed, the orientation of the port face 15 must match the fitting position. Integral port 16 is threaded in the preferred embodiment.

Electrode holders 13 are designed for compatibility with an air assist assembly. Normally, they will be different from the electrode holders described in U.S. Pat. No. 6,002,573.

Figure 4:
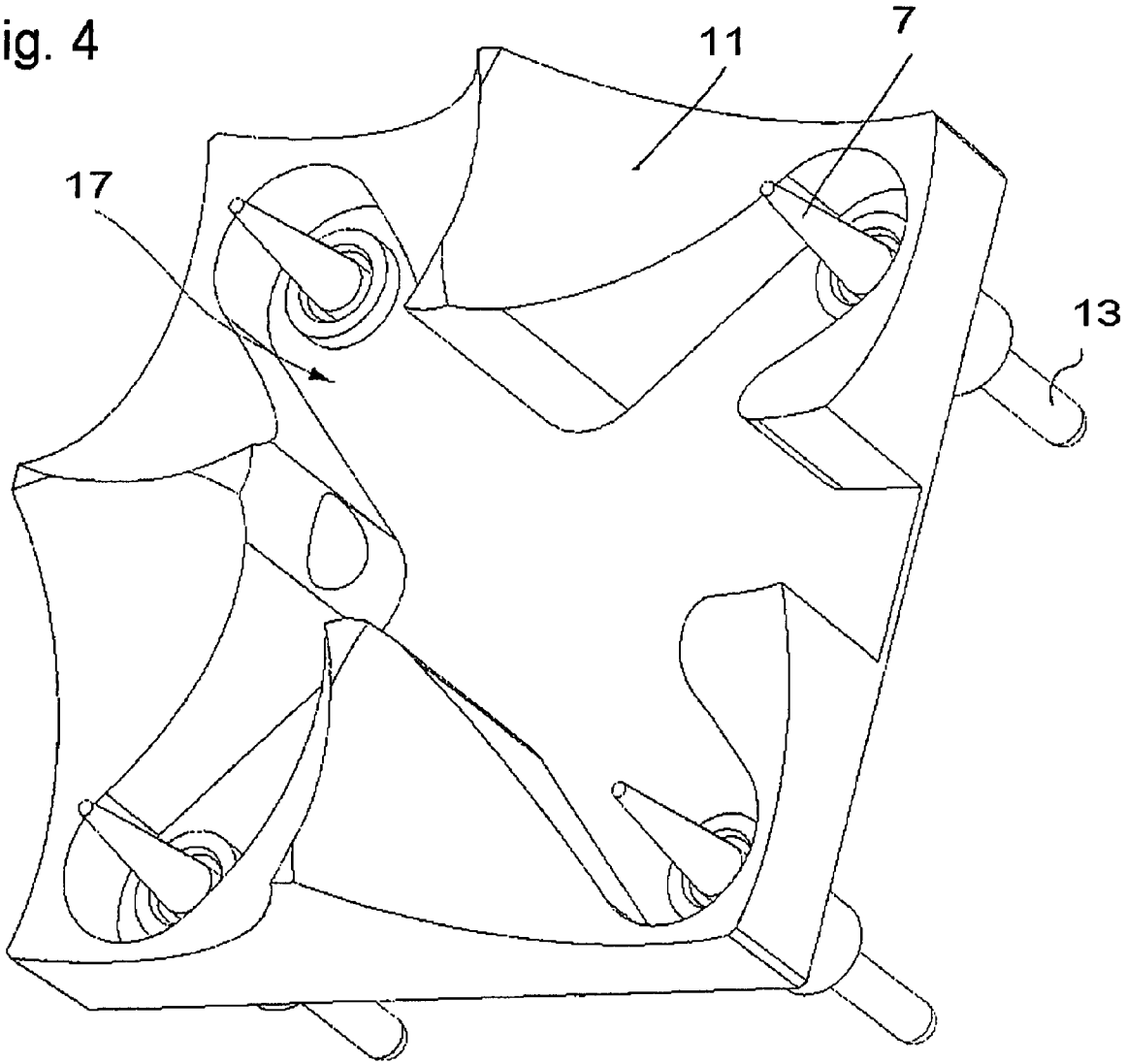
FIG. 4 is a top/right view of the external side of the air insert base without the air insert cross.

FIG. 4 shows the air insert base 11. The air insert cross 12 has been removed. The empty space 17 would normally be occupied by the air insert cross 12. Electrode holders 13 are installed at the outside ends of the empty space 17. In order to have sharp pointed tips 14 and still be within recessed cavity 4, electrode 7 has to have long conical shape. Silicon crystal electrodes can be easily broken, and it may be very hard to remove remnants from the voltage connector 5. That is the reason electrodes require intermediary electrode holders. The empty space 17 has a cross shape. This design makes the distance between electrodes 7 of opposite polarity longer than a straight line. A longer distance makes it harder to develop a dirty path between electrodes, and thus increases time between cleaning or replacement of air insert assemblies 2. The air insert cross 12 tightly fits inside empty space 17. The air insert cross 12 may be attached to the base 11 with glue, snap fit, welding, or other common techniques. Or it may rely on a tight fit and labyrinth sealing between surfaces of the air insert cross 12 and the air insert base 11.

Figure 5:
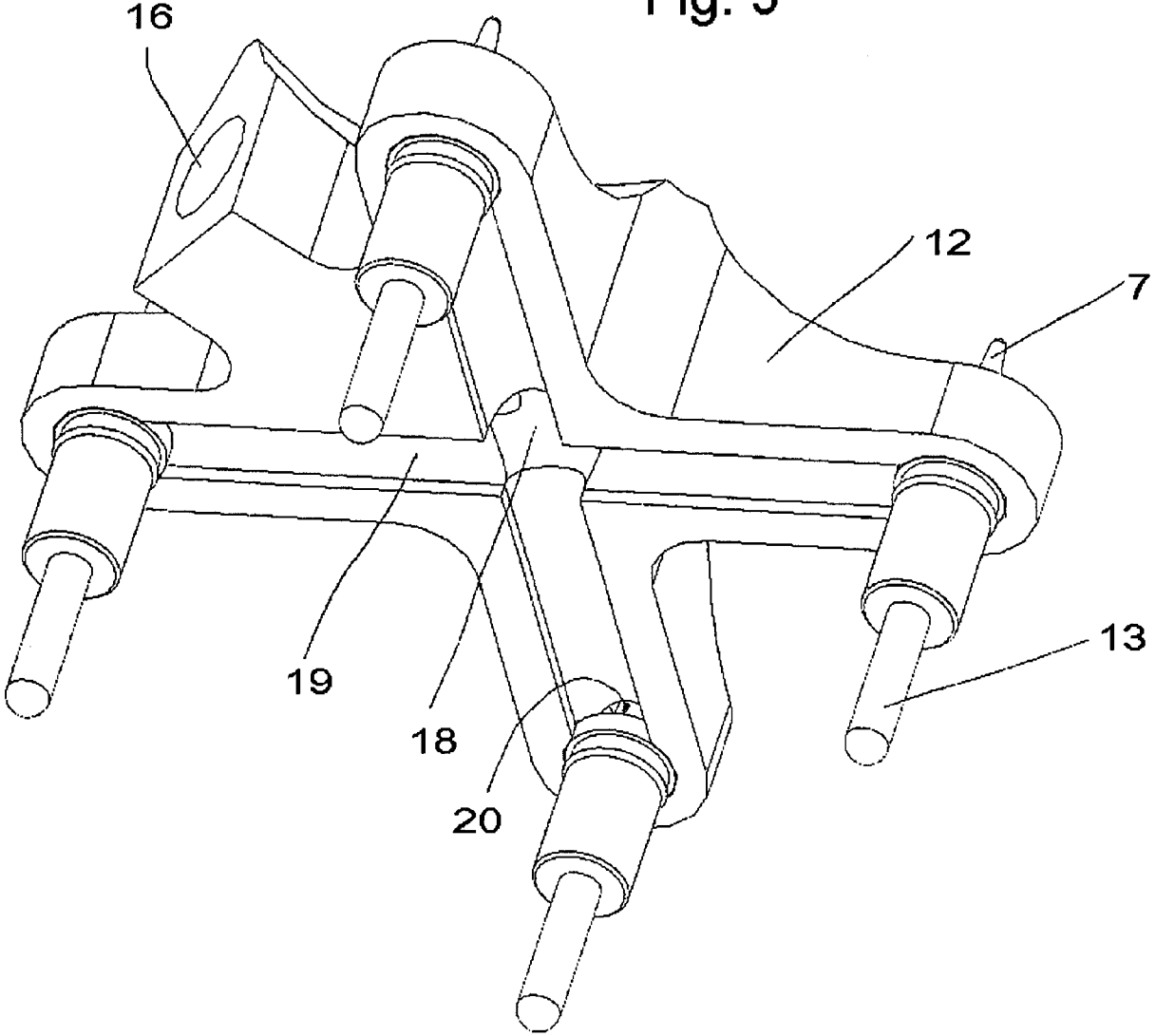
FIG. 5 is a bottom/right view of the internal (not visible) side of an air insert cross without the air insert base, showing air delivery grooves.

FIG. 5 provides a view underneath the air insert cross 12. It has been removed from the air insert base 11. In this preferred embodiment, pressurized air flows into the air insert cross 12 through the integral port 16. Then it flows downward through the vertical bore 18 into the four air delivery grooves 19 and through the ring gaps 20 between the holes 8 and the electrodes 7. The air delivery grooves 19 are equally long and the ring gaps 20 are equally sized. The size and shape of openings between the vertical bore or chamber 18 and air delivery grooves or channels 19 can be made different to compensate for redirecting of air flow vectors by grooves oriented in different directions. This provides equal airflow to each electrode 7. The design permits high volumes of airflow (typically, 10 to 50 liters per minute) with low-to-medium linear velocity and low backpressure. It is useful for discharging objects when balance is important and "hot spots" are problematic. Positive and negative ions are well mixed when the target is reached, and ion recombination is controlled.

Figure 6:
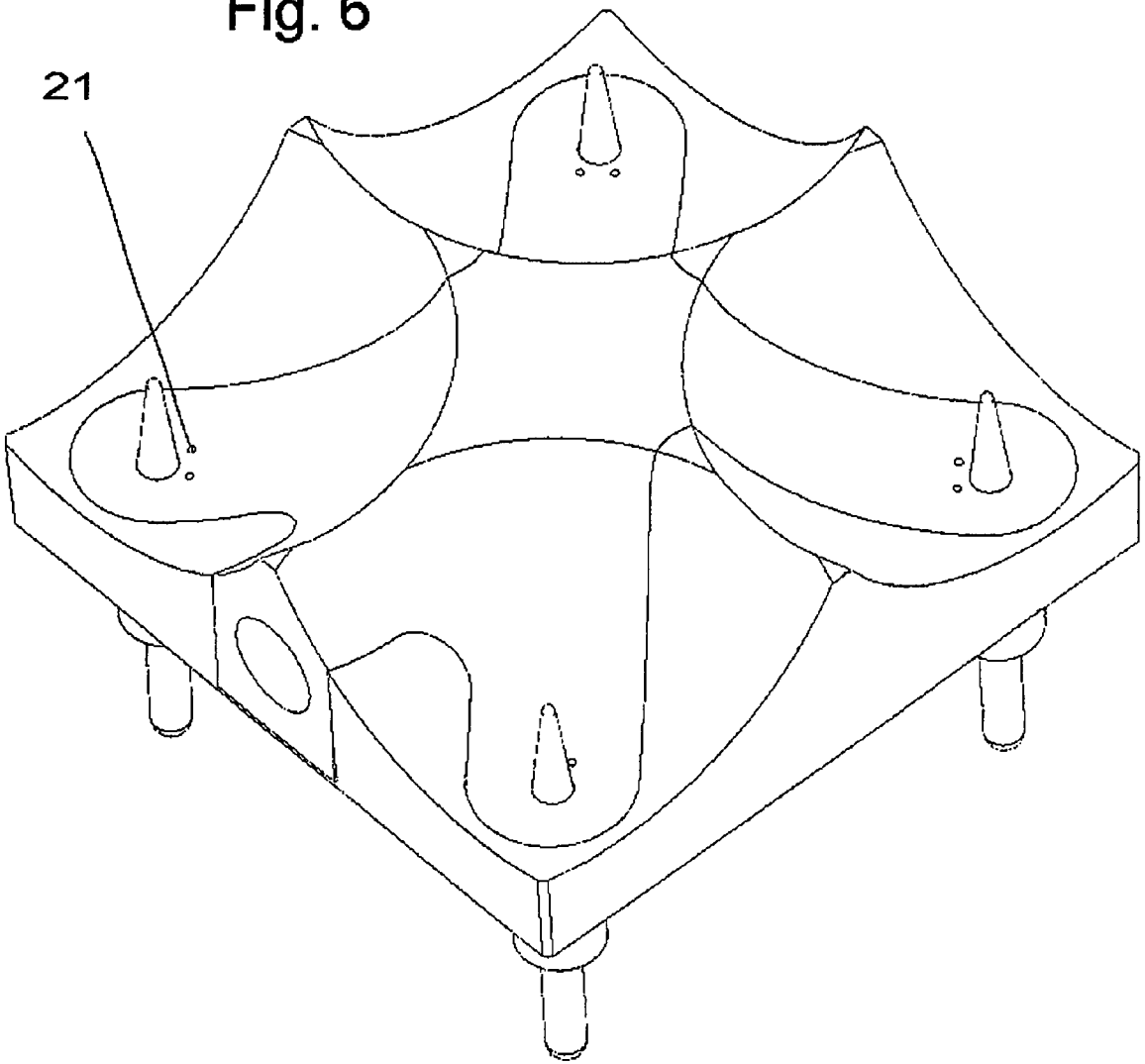
FIG. 6 is a top/left view of the external (visible) side of the air insert assembly (base and cross), showing pinholes for air delivery onto the electrodes.

FIG. 6 shows the first alternate method for delivering air to the electrodes 7. With this design, a ring gap 20 around each electrode 7 is not used. Instead the holes 8 around the electrodes 7 are sealed. Pressurized air flows through pinholes 21 adjacent to the electrodes 7. This configuration offers discharge times comparable to that achieved in the preferred embodiment (FIG. 5). It employs lower airflow volume (typically, 5 to 15 liters per minute), high backpressure, high velocity, greater distances, or a combination of the preceeding. It is useful for discharging distant objects when reducing air or nitrogen consumption is important. At close distance, balance is nearly as good as with the design in FIG. 5.

Figure 7:
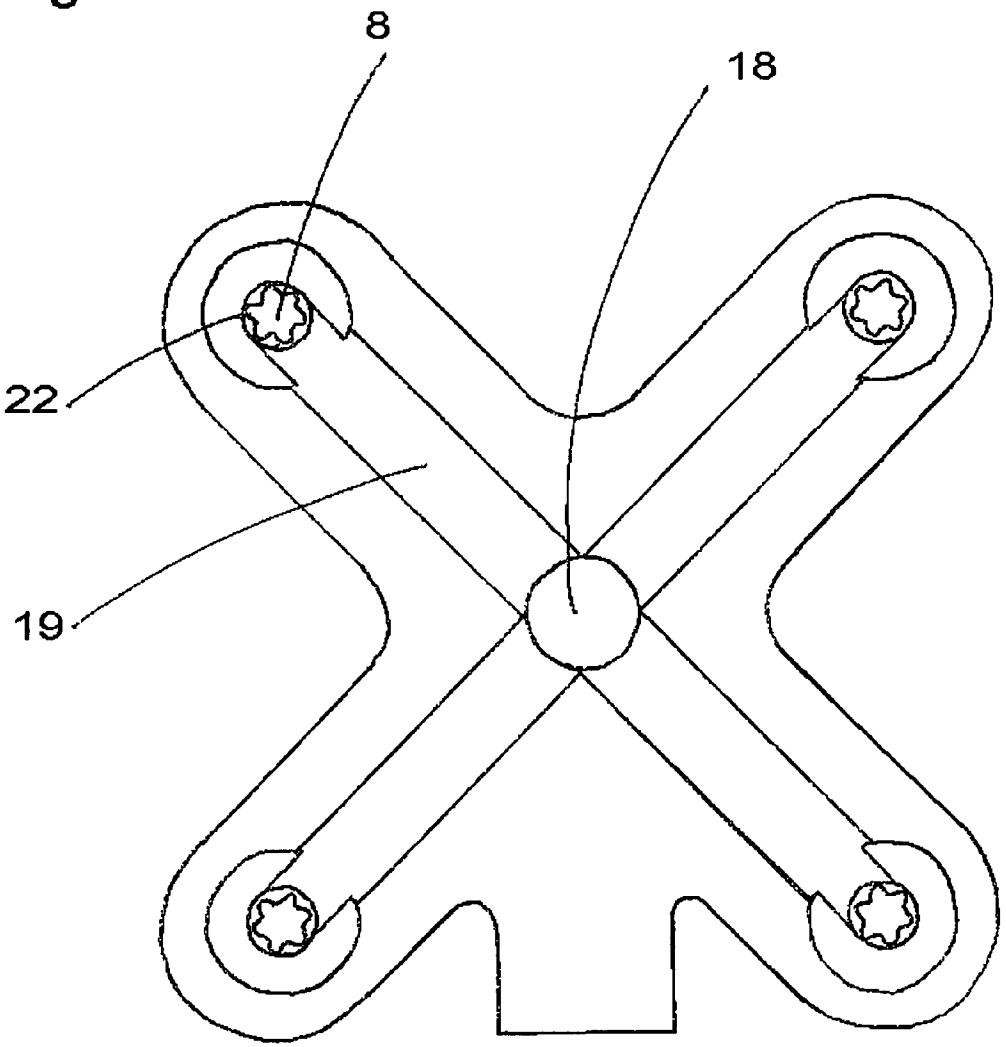
FIG. 7 shows a planar view of air insert assembly that employs toothed ring gaps for air delivery to the electrodes.

FIG. 7 shows the second alternate method for delivering air to the electrodes 7. Again, it is designed for discharging distant objects with low airflow volume at high backpressure and high velocity. This design retains the concept of a ring gap 20, but modifies it. Rather than an open ring gap 20, a toothed ring gap 22 is employed. It provides a higher restriction to air passage than the open ring gap 20.

Figure 8:
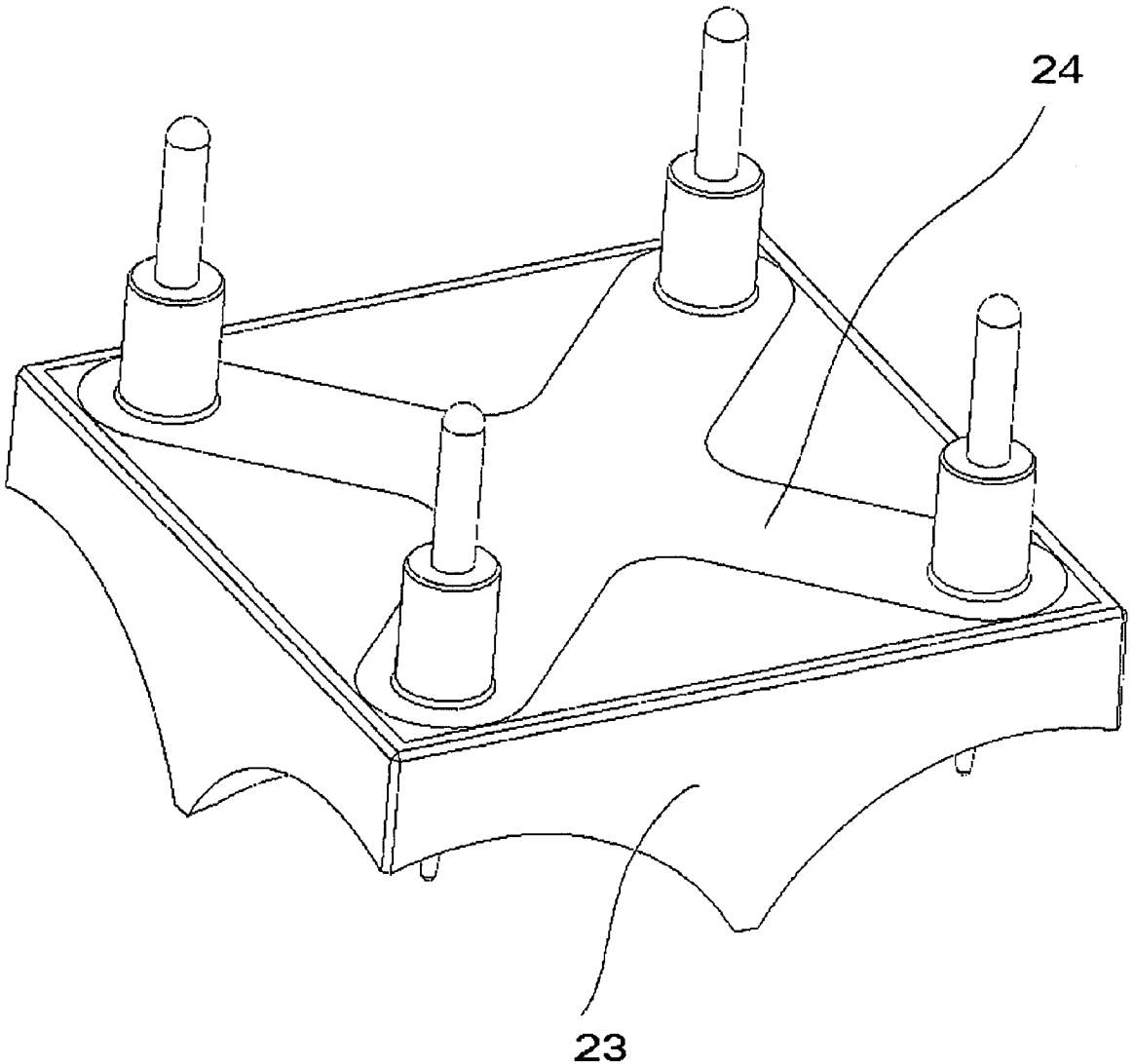
FIG. 8 shows one alternate embodiment of the air assist assembly with air channels enclosed by a flat bottom cover.
Figure 9:
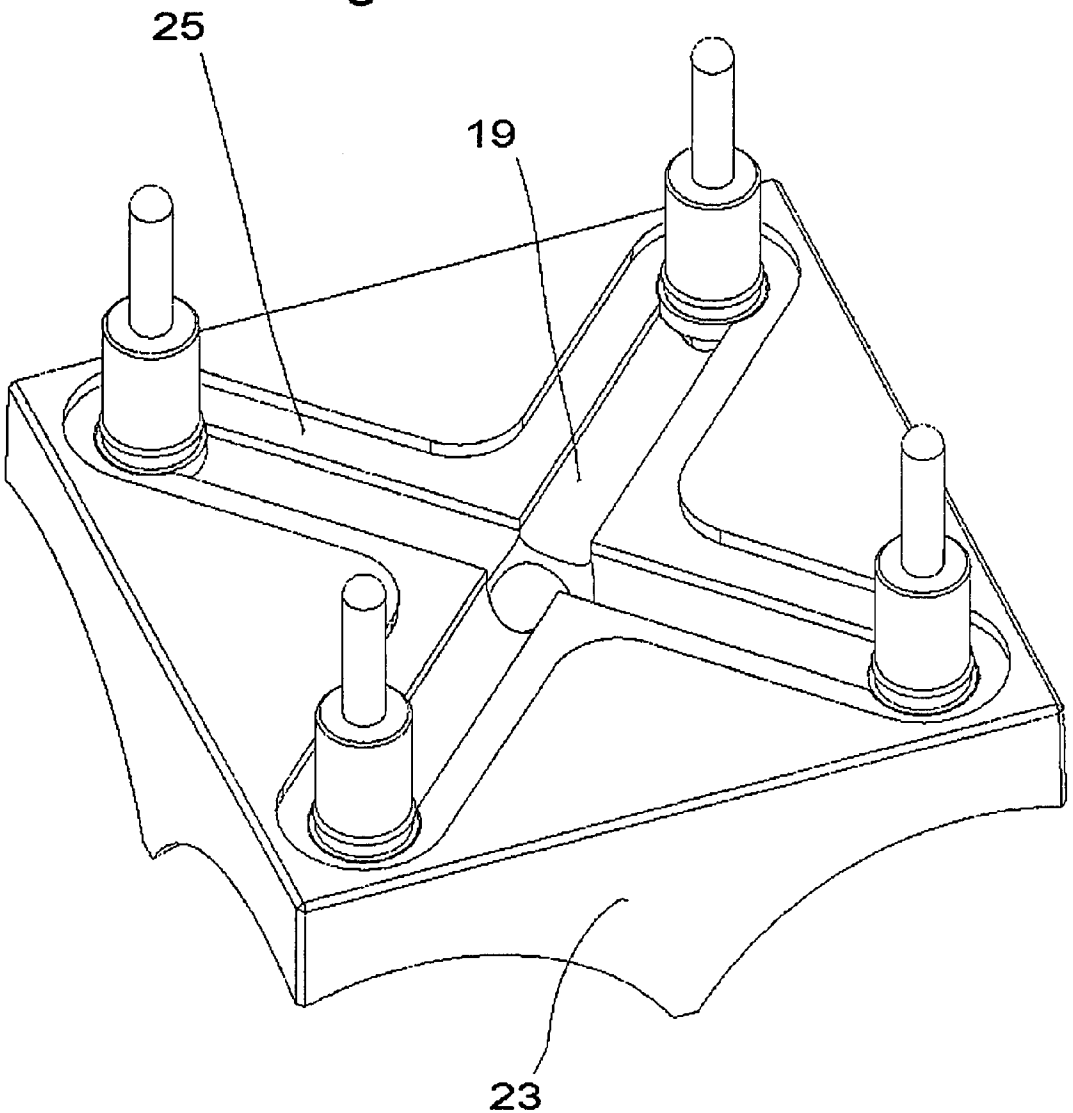
FIG. 9 shows the same air insert assembly in FIG. 8 with the flat bottom cover removed.

FIG. 8 and FIG. 9 describe the first alternate embodiment of the air assist assembly. In this case, the preferred air assist assembly 2 is not used. A solid curved surface 23 is used for the external surface, and a flat bottom cross 24 is used for the internal surface. The flat bottom cross 24 secures the electrode holders 13, and forms the bottom of the air delivery grooves 19. The flat bottom cross 24 fits into a shallow depression 25. This design may be used with either high volume airflow or low volume airflow.

Figure 10:
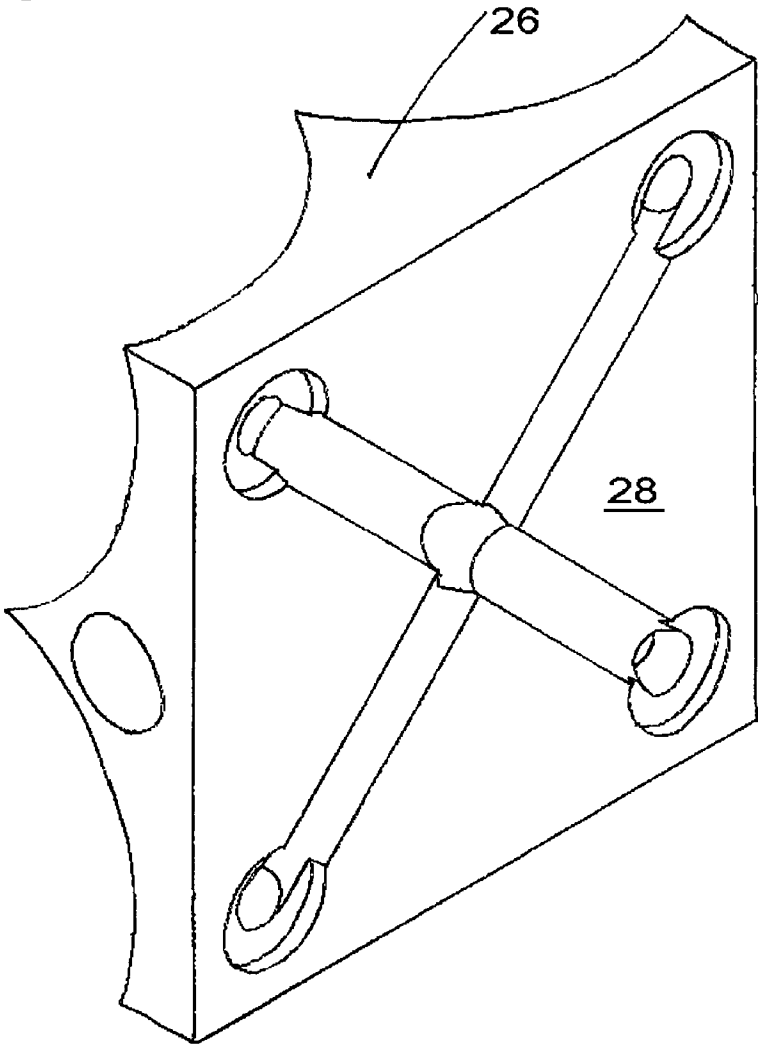
FIG. 10 shows a second alternate embodiment of the air assist assembly using only one piece.

FIG. 10 shows the second alternate embodiment for the air assist assembly. The preferred air assist assembly 2 is replaced with a one-piece assembly 26 with open air delivery grooves. The one-piece assembly 26 is sealed to the bottom of the recessed cavity 4. Hence, the bottom of the recessed cavity 4 serves as part of the air delivery grooves 19. Gaskets, adhesives or labyrinth seals are required between the one-piece assembly 26 and the bottom of the recessed cavity 4. The direction of air jets and air stream can be adjusted by changes in size, shape and location of hole 8, pinholes 21, or toothed rings 22. Also, the input air fitting 3 can be a part of the air insert cross 12, the air insert body 23, or the one-piece air insert 26. In this case, the side wall of recessed cavity 4 of the air assist self-balancing shielded bipolar ionizer 1 will have a slot instead of a hole to allow removal of the air insert assembly (or part).

The invention claimed is:

1. An improvement for a self-balancing shielded bipolar ionizer, which includes the following known elements:

a housing constructed of insulative material;

a recessed cavity (4);

electrodes (7) placed within the recessed cavity (4); and a self-balanced high voltage power supply;

whereas the improvement comprises:

an air insert assembly, used to direct a flow of air or nitrogen around each electrode, wherein the air insert assembly fits into the recessed cavity (4), is constructed of insulative material, has multiple concave external surfaces (10) to surround each electrode, has paths that distribute pressurized air or nitrogen to the electrodes (7), and has air holes (8) through which the electrodes protrude;

an air inlet fitting (3) to supply pressurized air or nitrogen; and electrode holders (13) that are compatible with both the air insert assembly and with high voltage connectors (5).

2. The ionizer in claim 1 where the air insert assembly (2) comprises an air insert base (11) and an air insert cross (12).

3. The ionizer in claim 2 where the air insert cross (12) includes an integral port (16) that receives the pressurized air or nitrogen from air inlet fitting (3), ducts the pressurized air through a vertical bore or chamber (18) to the air delivery groves or channels (19), and past the electrodes (7).

4. The ionizer in claim 1 where a first alternative air insert assembly is used, which comprises a solid curved surface (23) and a flat bottom cross (24).

5. The ionizer in claim 1 where another alternative air insert assembly (26) is used, which is a one-piece construction.

6. The ionizer in claim 2, 3, 4 or 5 where the air inlet fitting (3) and air insert assembly or insert cross form one part that receive air or nitrogen.

7. The ionizer in claims 1 or 5, where the air assist assembly is hermetically sealed into the recessed cavity (4) to minimize air leakage between the air assist assembly and the walls of the recessed cavity (4).

8. The ionizer in claims 1 or 5, where the floor of the recessed cavity (4) forms one boundary of the air delivery grooves (19).

9. The ionizer in claims 1, 2, 3, or 4 where the air insert assembly, the electrodes (7), and the electrode holders (13) constitute a removable subassembly.

10. The ionizer in claim 6 where the air insert assembly, the electrodes (7), and the electrode holders (13) constitute a removable subassembly.

11. The ionizer in claims 1, 2, 3, 4, or 5 where each electrode tip (14) is situated in the focal point of its surrounding curved surface.

12. The ionizer in claim 6 where each electrode tip (14) is situated in the focal point of its surrounding curved surface.

13. The ionizer in claims 1, 2, 3, 4, or 5 where the number of concave surfaces contained by the air assist assembly is equal to the number of electrodes (7).

14. The ionizer in claim 6 where the number of concave surfaces contained by the air assist assembly is equal to the number of electrodes (7).

15. The ionizer in claims 1, 2, 3, 4, or 5 where the path to distribute pressurized air includes a vertical bore or chamber (18) as part of an air assist assembly.

16. The ionizer in claim 6 where the path to distribute pressurized air includes a vertical bore or chamber (18) as part of an air assist assembly.

17. The ionizer in claims 1, 2, 3, 4, or 5 where the path to distribute pressurized air includes air delivery grooves or channels (19) of equal length connected to the vertical bore or chamber (18) through openings.

18. The ionizer in claim 17 where opening areas are not equal to each other.

19. The ionizer in claim 6 where the path to distribute pressurized air includes air delivery grooves or channels (19) of equal length connected to the vertical bore or chamber (18) through openings.

20. The ionizer in claim 19 where opening areas are not equal to each other.

21. The ionizer in claims 1, 2, 3, 4, or 5 where air inlet fitting (3) penetrates the wall of the recessed cavity (4).

22. The ionizer in claim 6 where air inlet fitting (3) penetrates the wall of the recessed cavity (4).

23. The ionizer in claims 1, 2, 3, 4, or 5 where ring gaps (20) are used to direct the pressurized air or nitrogen past the electrodes (7).

24. The ionizer in claim 6 where ring gaps (20) are used to direct the pressurized air or nitrogen past the electrodes (7).

25. The ionizer in claims 1, 2, 3, 4, or 5 where pinholes (21) are used to direct the pressurized air or nitrogen past the electrodes (7).

26. The ionizer in claim 6 where pinholes (21) are used to direct the pressurized air or nitrogen past the electrodes (7).

27. The ionizer in claims 1, 2, 3, 4, or 5 where toothed ring gaps (22) are used to direct the pressurized air or nitrogen past the electrodes (7).

28. The ionizer in claim 6 where toothed ring gaps (22) are used to direct the pressurized air or nitrogen past the electrodes (7).

29. The ionizer in claims 1, 2, 3, or 4 where electrodes (7) have sharp pointed tips (14), protruding through the exterior side of air insert assembly, and electrode holders (13) protrude through bottom portion of the air insert assembly into high voltage connectors (5) situated beneath the bottom of the recessed cavity (4).

30. The ionizer in claim 6 where electrodes (7) have sharp pointed tips (14), protruding through the exterior side of air insert assembly, and electrode holders (13) protrude through bottom portion of the air insert assembly into high voltage connectors (5) situated beneath the bottom of the recessed cavity (4).

* * * * *